US010258821B2

(12) United States Patent
Jeong

(10) Patent No.: US 10,258,821 B2
(45) Date of Patent: Apr. 16, 2019

(54) MULTI-FUNCTIONAL EXERCISE APPARATUS

(71) Applicant: Yeonok Jeong, Gyeongsangnam-Do (KR)

(72) Inventor: Yeonok Jeong, Gyeongsangnam-Do (KR)

( * ) Notice: Subject to any disclaimer, the term of this patent is extended or adjusted under 35 U.S.C. 154(b) by 0 days.

(21) Appl. No.: 15/519,546

(22) PCT Filed: Nov. 19, 2015

(86) PCT No.: PCT/KR2015/012448
§ 371 (c)(1),
(2) Date: Apr. 16, 2017

(87) PCT Pub. No.: WO2016/085192
PCT Pub. Date: Jun. 2, 2016

(65) Prior Publication Data

US 2017/0239517 A1 Aug. 24, 2017

(30) Foreign Application Priority Data

Nov. 24, 2014 (KR) ..... 10-2014-0164810
Nov. 16, 2015 (KR) ..... 10-2015-0160152

(51) Int. Cl.
*A63B 21/00* (2006.01)
*A63B 22/00* (2006.01)
(Continued)

(52) U.S. Cl.
CPC .... *A63B 23/03575* (2013.01); *A63B 21/4034* (2015.10); *A63B 21/4035* (2015.10);
(Continued)

(58) Field of Classification Search
CPC ..... A63B 23/03575; A63B 22/0023; A63B 22/16; A63B 22/04; A63B 21/4035;
(Continued)

(56) References Cited

U.S. PATENT DOCUMENTS 4,200,282 A * 4/1980 Agyagos ..... A63B 17/00 482/147
4,376,532 A * 3/1983 Hunstad ..... A63B 69/18 482/146
(Continued)

FOREIGN PATENT DOCUMENTS

KR 20-2011-0004642 U 5/2001
KR 20-2009-0007412 U 7/2009
(Continued)

OTHER PUBLICATIONS

Korean Intellectual Property Office, international Search Report dated Mar. 11, 2016.

*Primary Examiner* — Garrett K Atkinson
(74) *Attorney, Agent, or Firm* — Li & Cai Intellectual Property (USA) Office

(57) ABSTRACT

The present invention relates to a multi-functional exercise apparatus, and particularly to a multi-functional exercise apparatus which is safe and allows various exercises with different setups to be performed by means of a single apparatus. The present invention, relating to a multi-functional exercise apparatus provided so as to impart a sense of stability to a user when exercising while at the same time allowing various exercises with different setups to be performed by means of a single apparatus, comprises: a plate-shaped body (A) forming the floor surface and having a space in the interior thereof; fixed frames (100) fixedly disposed upwardly on both sides of the body (A); rotatable frames disposed upwardly on both sides of the body (A); handle parts (200) connected on one side of the rotatable frames and provided so as to be movable forwards and backwards; and a foot plate part rotatably provided on upper surface of the body (A) and connected to the other side of the rotatable frames. The multi-functional exercise apparatus according to the present invention imparts a sense of sta-
(Continued)

bility to a user as the rotatable frame comprises a plurality of linked sections and connects the handle parts and foot plate part, allowing the user to exercise by rotating not the entire rotatable frames but only the handle parts which are comparatively short compared to the rotatable frames. Furthermore, each linked section of the rotatable frames is rotatably attached to the handle part or to the side of the fixed frame, allowing the rotatable frames to stably transmit driving power from the handle parts (200) to the foot plate part and to be changed so as to allow various exercises with different setups to be performed.

10 Claims, 13 Drawing Sheets

(51) Int. Cl.
*A63B 22/04* (2006.01)
*A63B 22/16* (2006.01)
*A63B 23/035* (2006.01)

(52) U.S. Cl.
CPC ..... *A63B 22/001* (2013.01); *A63B 22/0023* (2013.01); *A63B 22/04* (2013.01); *A63B 22/16* (2013.01)

(58) Field of Classification Search
CPC ... A63B 21/4034; A63B 22/001; A63B 23/10; A63B 23/0405; A63B 23/03525; A63B 22/06
See application file for complete search history.

(56) References Cited

U.S. PATENT DOCUMENTS 5,290,211 A * 3/1994 Stearns ..... A63B 21/00178 482/51
5,496,235 A * 3/1996 Stevens ..... A63B 21/015 434/255
5,632,711 A * 5/1997 Hwang ..... A63B 22/14 482/146
5,792,028 A * 8/1998 Jarvie ..... A63B 22/001 482/51
5,876,307 A * 3/1999 Stearns ..... A63B 22/001 482/51
6,416,442 B1 * 7/2002 Stearns ..... A63B 22/001 482/52
6,648,801 B2 * 11/2003 Stearns ..... A63B 22/001 482/52
7,137,927 B2 * 11/2006 Maresh ..... A63B 22/0007 482/52
7,520,839 B2 * 4/2009 Rodgers, Jr. ..... A63B 22/001 482/51
7,556,591 B2 * 7/2009 Chuang ..... A63B 22/001 482/51
7,651,445 B1 * 1/2010 Chen ..... A63B 22/001 482/51
7,828,698 B2 * 11/2010 Rodgers, Jr. ..... A63B 22/001 482/51
7,981,007 B1 * 7/2011 Chu ..... A63B 21/225 482/52
8,029,416 B2 * 10/2011 Eschenbach ..... A63B 22/0017 482/52
8,206,271 B2 * 6/2012 Chu ..... A63B 21/225 482/52
8,454,478 B2 * 6/2013 Giannelli ..... A63B 22/001 482/51
9,050,498 B2 * 6/2015 Lu ..... A63B 21/154
9,623,282 B2 * 4/2017 Tung ..... A63B 21/0552
2001/0004623 A1 * 6/2001 Miller ..... A63B 22/001 482/52
2001/0051562 A1 * 12/2001 Stearns ..... A63B 22/001 482/51
2008/0287265 A1 * 11/2008 Giannelli ..... A63B 22/001 482/52
2009/0239713 A1 * 9/2009 Chu ..... A63B 21/225 482/51
2012/0108406 A1 * 5/2012 Jeong ..... A63B 21/159 482/146

FOREIGN PATENT DOCUMENTS

KR 20-2009-0011554 U 11/2009
KR 1011586330000 * 5/2010 ..... A63B 22/04
KR 10-1158633 B1 6/2012
KR 10-2013-0053612 A 5/2013

* cited by examiner

[a]

[b]

MULTI-FUNCTIONAL EXERCISE APPARATUS

TECHNICAL FIELD

The present invention relates to a multi-functional exercise apparatus, and more particularly, to a multi-functional exercise apparatus which is safe and allows a user to perform a variety of different exercises through a single apparatus.

BACKGROUND ART

In general, exercise apparatuses refer to various means and apparatuses which are used by users to perform exercises, and most of the related-art exercise apparatuses are installed outdoors and indoors like chin-up bars, parallel bars, treadmills, or the like, and allow users to perform only one type of exercise through a single apparatus. Therefore, there is inconvenience that users should use various types of exercise apparatuses to perform different types of exercises as they desire.

To avoid such users' inconvenience, exercise apparatuses enabling users to perform various types of exercises through a single apparatus have been developed, and an example of these exercise apparatuses is disclosed in Korean Patent Registration No. 10-0774919 (hereinafter, referred to as a "cited invention").

As shown in FIG. 1, the cited invention includes: a pair of rotatable frames which are rotatably inserted into a body 1; an oscillating linkage 2 which is shaft-supported in the body 1 and performs a seesaw operation; skipping handle parts 5 which are rotatably disposed at predetermined positions of the rotatable frames; a linkage mechanism which allows the oscillating linkage 2 to perform the seesaw operation by the rotation of the skipping handle parts 5; and a skipping foot plate 3 which is rotatably disposed on the upper portion of the body 1 and is rotated as one end of the oscillating linkage 2 hits the bottom surface thereof, and the cited invention enables users to perform skipping, rowing, and balancing simultaneously.

However, since the rotatable frames of the cited invention, which rotate forwards and backwards or rotate to the right and the left, have a long length, there are problems that the cited invention does not provide a sense of stability to users when they do the above-described exercises, and also, is not appropriate for users to perform a variety of different exercises to strengthen or maintain parts of their bodies they desire.

DETAILED DESCRIPTION OF THE PRESENT DISCLOSURE

Technical Objects

The present invention has been developed to solve the above-described problems, and an object of the present invention is to provide a multi-functional exercise apparatus which provides a sense of stability to a user when the user does an exercise, and simultaneously, allows the user to perform a variety of different exercises through a single apparatus.

Technical Solving Means

The present invention relates to a multi-functional exercise apparatus which provides a sense of stability to a user when the user does an exercise, and simultaneously, allows the user to perform a variety of different exercises through a single apparatus, the multi-functional exercise apparatus including: a plate-shaped body A which forms a bottom surface and has a space formed therein; fixed frames 100 which are fixedly disposed on both sides of the body A in an upward direction; rotatable frames which are disposed on both sides of the body A in an upward direction and provided so as to be rotatable; handle parts 200 which are connected with one side of the rotatable frames and provided so as to be rotatable forwards and backwards; and foot plate parts which are provided on a top surface of the body A and are connected with the other side of the rotatable frames and provided so as to be rotatable,

Effect of the Invention

In the multi-functional exercise apparatus according to the present invention, the rotatable frames include a plurality of links and interlock the handle parts and the foot plate parts. Therefore, the user can exercise by simply rotating only the handle parts relatively shorter than the rotatable frames, rather than by rotating the whole rotatable frames, and thus can feel a sense of stability.

In addition, since the links forming the rotatable frames are rotatably connected with the handle parts or the side surfaces of the fixed frames, the rotatable frames can stably transmit a driving force from the handle parts 200 to the foot plate parts, and also, can be changed so as to allow the user to perform a variety of different exercises.

BEST MODE FOR EMBODYING THE INVENTION

Specific matters of the present invention including the object to be solved, the means for solving the object, and the effect of the present invention as described above are included in the embodiments and the drawings, which will be described below. The advantages and features of the present invention, and methods for achieving the same will be apparent with reference to the embodiments which will be described below with the accompanying drawings.

The present invention relates to a multi-functional exercise apparatus which provides a sense of stability to a user when the user does an exercise, and simultaneously, allows the user to perform a variety of different exercises through a single apparatus, and includes: a plate-shaped body A which forms a bottom surface and has a space formed therein; fixed frames 100 which are fixedly disposed on both sides of the body A in an upward direction; rotatable frames which are upwardly disposed on both sides of the body A and provided so as to be rotatable; handle parts 200 each of which is connected to one side of each of the rotatable frames and provided so as to be rotatable forwards and backwards; and foot plate parts which are provided on the top surface of the body A and each of which is connected to the other side of each of the rotatable frames and provided so as to be rotatable.

First, the body A is formed in a plate shape and supported on a bottom.

Figure 1:
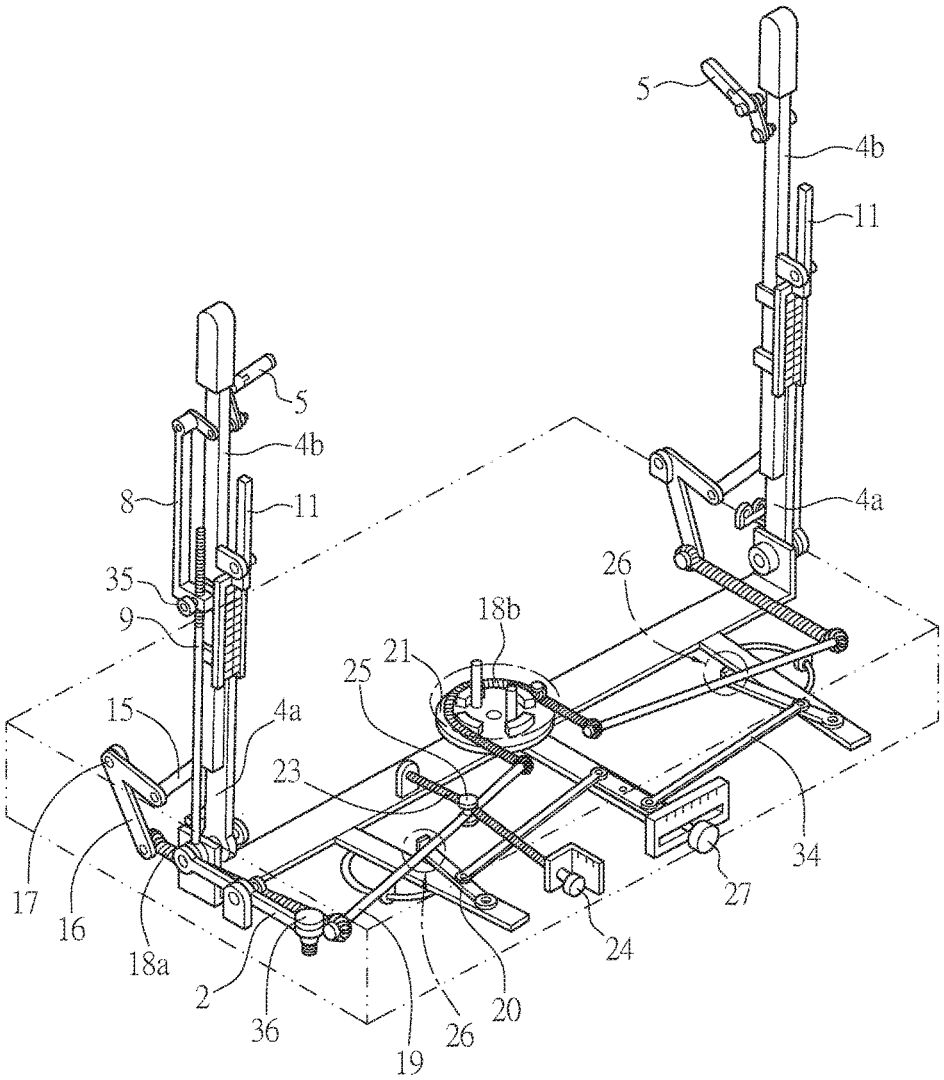
FIG. 1 is a perspective view showing a structure of a related-art multi-functional exercise apparatus.
Figure 2:
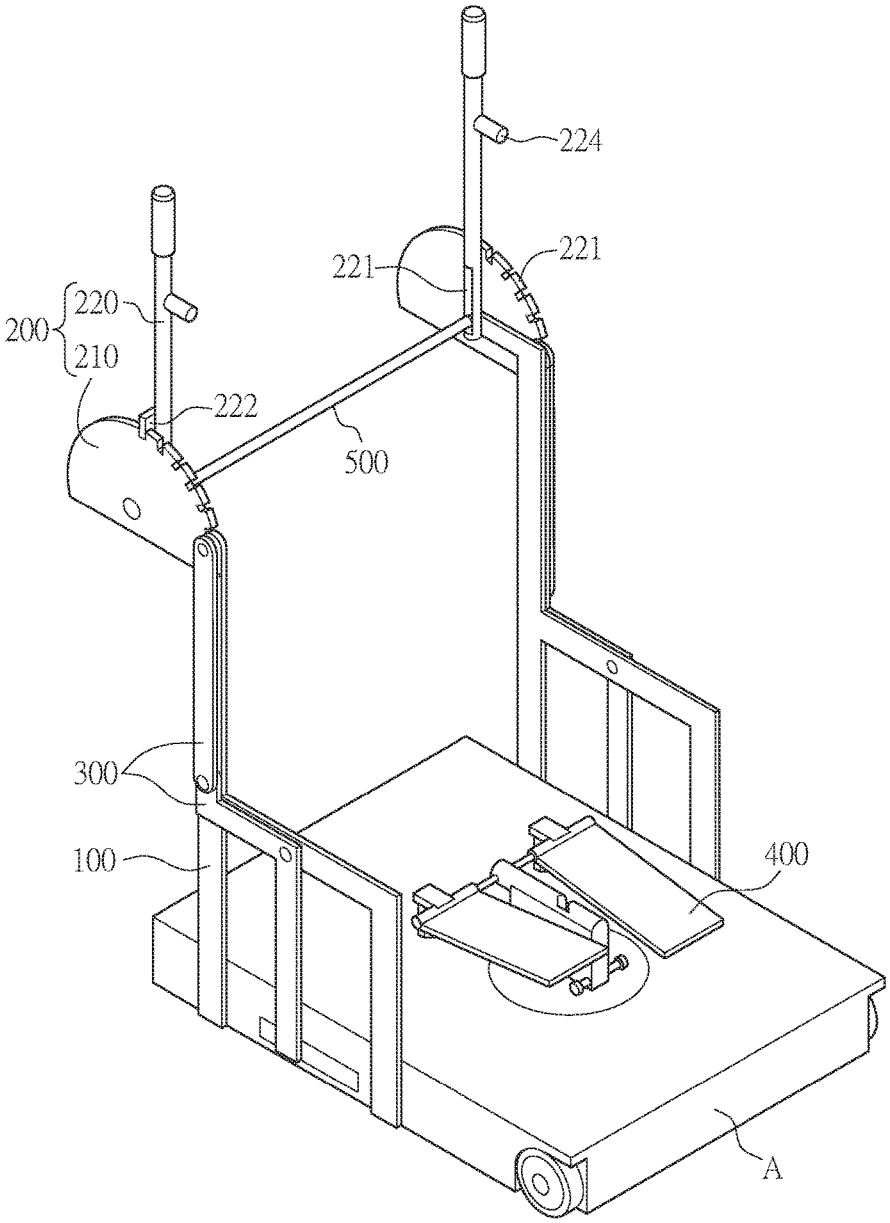
FIG. 2 is a perspective view showing the entirety of a multi-functional exercise apparatus of the present invention.
Figure 3:
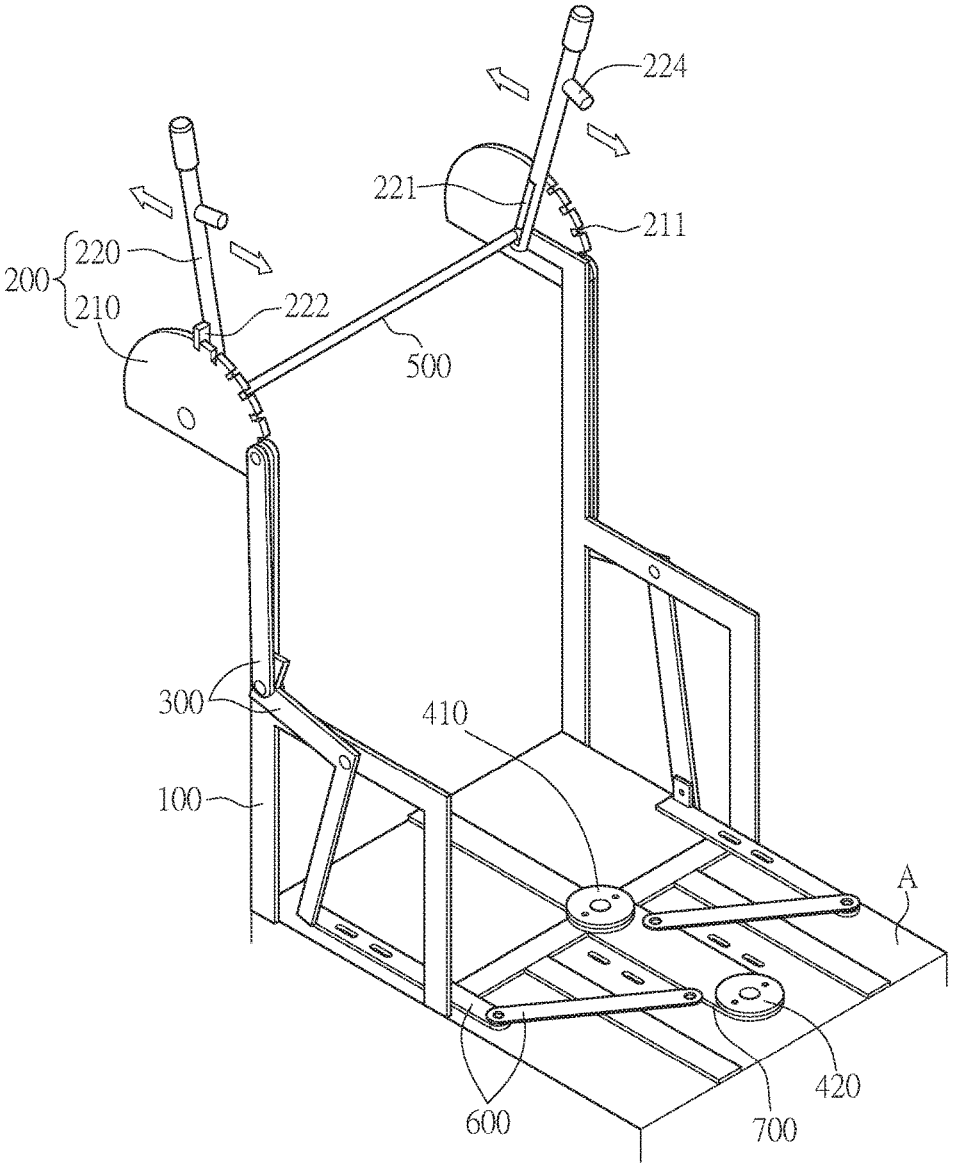
FIG. 3 is a perspective view showing an internal structure of the multi-functional exercise apparatus according to the present invention, and an example of driving thereof.
Figure 4:
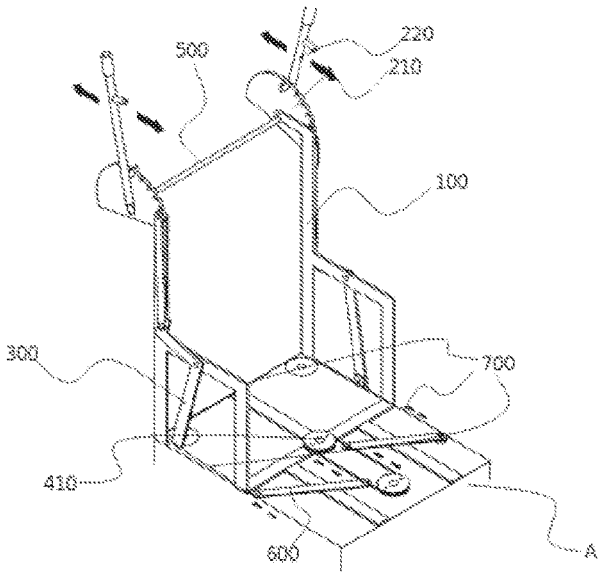
FIG. 4 is a perspective view showing an example of the interior of the multi-functional exercise apparatus of the present invention which is driven with a rope.

Specifically, as shown in FIGS. 2 to 4, the body A is a part forming the bottom surface of the multi-functional exercise apparatus according to the present invention, and allows a person to get thereon and to perform an exercise.

The body A may be provided with a plurality of wheels formed on the bottom surface so as to be easily moved, and has a space formed therein to accommodate therein a rope 700 connection structure and a link-joint structure for connecting the foot plate parts 400 and the rotatable frames 300.

In addition, the body may be provided with a base plate 430 formed on the front portion of the top surface thereof and configured to be able to adjust an incline to be elevated toward the user, such that the user can selectively adjust the incline.

Next, the fixed frames 100 are fixedly disposed on both side surfaces of the body A in the upward direction.

Specifically, the fixed frames 100 are formed in an "h"-shape as shown in FIGS. 2 to 4, and are fixedly disposed on both side surfaces of the body A in the upward direction, and the handle parts 200 are shaft-connected with the upper portions of the fixed frames 100 toward outside so as to be rotatable forwards and backwards.

Figure 8:
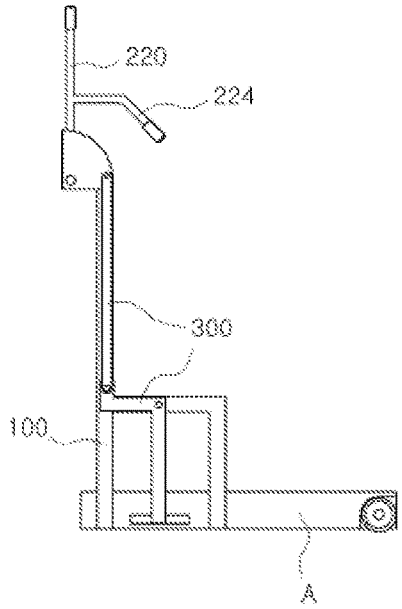
FIG. 8 is a perspective view showing structures of an upper fixed frame and a lower fixed frame applied to the multi-functional exercise apparatus of the present invention.
Figure 9:
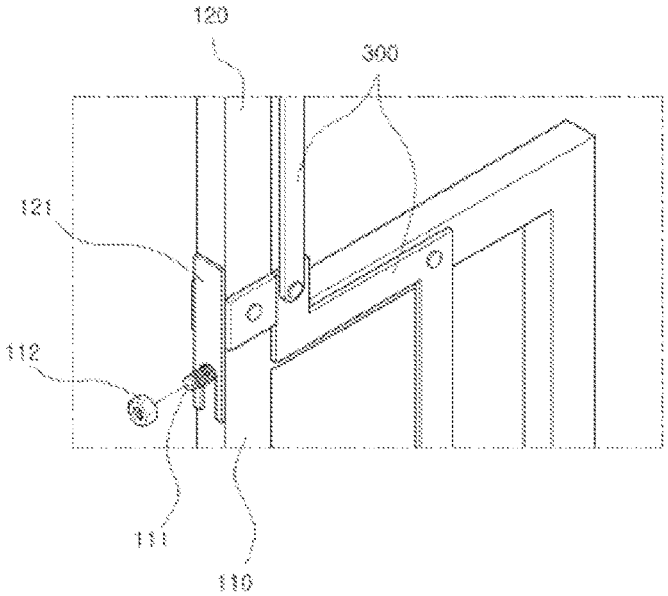
FIG. 9 is a perspective view showing a connection structure of the upper fixed frame and the lower fixed frame applied to the multi-functional exercise apparatus of the present invention.
Figure 10:
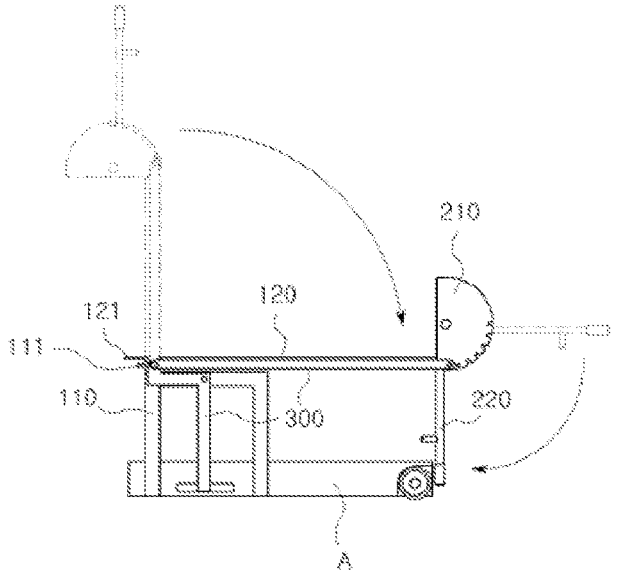
FIG. 10 is a view showing an example of the upper fixed frame which is applied to the multi-functional exercise apparatus of the present invention and is rotated.

More specifically, as shown in FIGS. 8 to 10, the fixed frames 100 may include lower fixed frames 110 which are fixedly disposed on the both side surfaces of the body A, and upper fixed frames 120, each of which has a lower end rotatably connected with the upper end of each of the lower fixed frames 110 and has an upper end connected with each of the handle parts 200 rotating forwards and backwards. The handle parts 200 and the upper fixed frames 120 are rotatable about the lower fixed frames 110 and thus are configured to be foldable, such that the multi-functional exercise apparatus can be easily stored.

An example of the upper fixed frames 120 being rotatably connected with the lower fixed frame 110 will be described in detail. As shown in FIG. 9, the lower fixed frame 110 may have a fixing protrusion 111 formed at a location spaced from the upper end thereof on the front surface thereof, and the upper fixed frame 120 may have an inserting mechanism 121 formed on the front surface thereof, having a predetermined length, and having a recess formed at a lower end thereof to receive the fixing protrusion 111. Herein, the fixed frame 100 may further include a fixing mechanism 112 secured to the fixing protrusion 111 and brought into contact with the inserting mechanism 121 when being secured to the fixing protrusion 111.

To do an exercise using the apparatus of the present invention, the user raises the upper fixed frames 120 which have been folded backwards by rotating the upper fixed frames 120 forwards, lets the fixing protrusion 111 be inserted into the inserting mechanism 121, and then secures the fixing mechanism 112 to the fixing protrusion 111. In addition, to store the apparatus of the present invention after using it, the user releases the fixing mechanism 112 from the fixing protrusion 111 and then rotates the upper fixed frames 120 backwards.

Next, the rotatable frames 300 are disposed upwardly on both sides of the body A and provided so as to be rotatable.

Specifically, the rotatable frames 300 are connected with the fixed frames 100 by means of links and joints and provided so as to be rotatable.

The links and joints forming the rotatable frames 300 may be formed in various shapes. For example, as shown in FIGS. 2 to 4, the links may include an "l"-shaped link and a "]"-shaped link. The "l"-shaped link has one end rotatably connected with the handle part 200 and the other end rotatably connected with the "]"-shaped link, and the "]"-shaped link has one end connected with the "l"-shaped link and the other end connected with the rope 700 or the link-joint structure interlocked with the foot plate parts 400, which will be described below. In this case, the "l"-shaped link is rotatably shaft-connected with the handle part 200 and the "]"-shaped link is rotatably shaft-connected with the side surface of the fixed frame 100, such that the rotatable frames 300 can stably transmit a driving force from the handle parts 200 to the foot plate parts 400.

The rotatable frames 300 include the plurality of links interlocked with one another, and the links are rotatably connected to the handle part 200 or the side surface of the fixed frame 100. Therefore, by simply moving only the handle parts 200 when exercising, the user can perform a rowing exercise using the handle parts 200 and a twist exercise using the foot plate parts 400 since the rotatable frames 300 move in association with the handle parts 200 and the foot plate parts 400 interlocked with the rotatable frames 300 rotate to the right and the left.

According to the present invention as described above, since the user performs an exercise by rotating only the handle parts 200, which are interlocked with the rotatable frames 300 and are relatively shorter than the rotatable frames 300, rather than doing a rowing exercise by moving the whole rotatable frames 300, a radius of rotation of the handle parts 200 is reduced and thus a sense of stability is provided to the user.

Next, the foot plate parts 400 are disposed on the upper portion of the body A and are interlocked with the rotatable frames 300 and provided so as to be rotatable to the right and the left.

Figure 11:
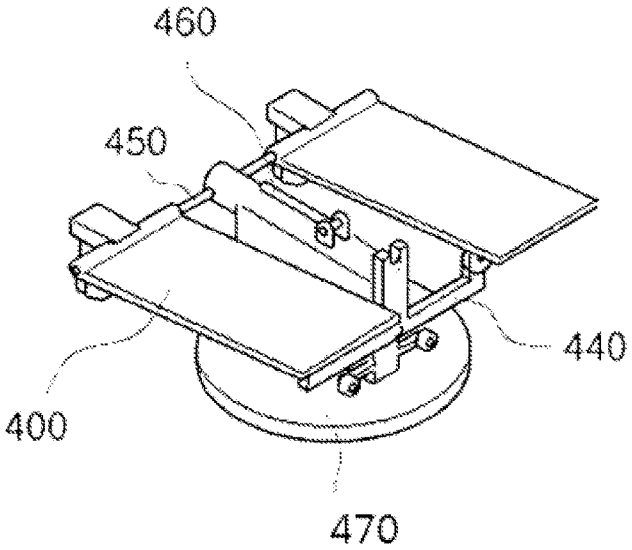
FIG. 11 is a perspective view showing a structure of foot plate parts applied to the multi-functional exercise apparatus of the present invention.
Figure 12:
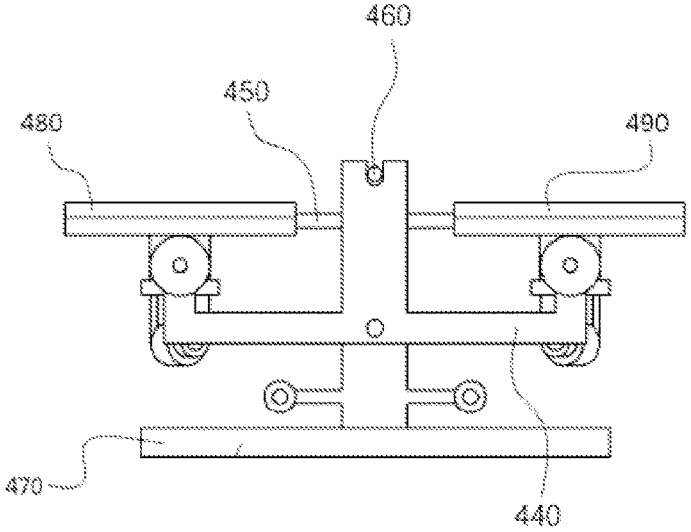
FIG. 12 is a rear view showing the structure of the foot plate parts applied to the multi-functional exercise apparatus of the present invention.

Specifically, as shown in FIGS. 11 and 12, the foot plate parts 400 include a support plate 470, a left foot plate 480, and a right foot plate 490, and the support plate 470 forms a bottom surface in the foot plate parts 400.

The left foot plate 480 is provided on one side of the upper portion of the support plate 470 and configured to have a foot placed thereon.

The right foot plate 490 is provided on the other side of the upper portion of the support plate 470 and configured to have a foot placed thereon.

In this case, the left foot plate 480 and the right foot plate 490 are configured to be rotatable with the fore parts thereof having a fixed height, and the back parts thereof connected with each other in a seesaw form, such that a step exercise can be naturally performed when the foot plate parts 400 are rotated.

Figure 14:
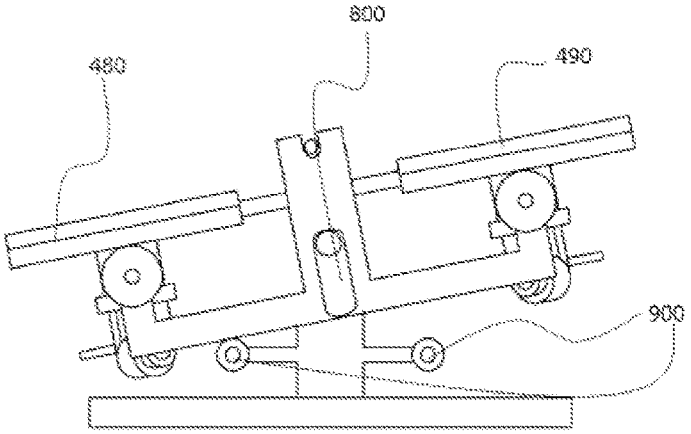
FIG. 14 is a rear view showing a moving pattern of the foot plate parts when a user does a step exercise on the foot plate parts applied to the multi-functional exercise apparatus of the present invention.

In addition, the left foot plate 480 and the right foot plate 490 may have protrusions formed on the back parts thereof as shown in FIG. 14, and, it is preferable that stopping protrusions 900 are further provided so as to prevent the lower portions of the left foot plate 480 and the right foot plate 490 from being brought into contact with the bottom when the user does a step exercise using the foot plate parts. This is to prevent the bottom surfaces of the left foot plate 480 and the right foot plate 490 from being damaged due to a friction on the bottom when the user does a step exercise on the foot plate parts.

Figure 15:
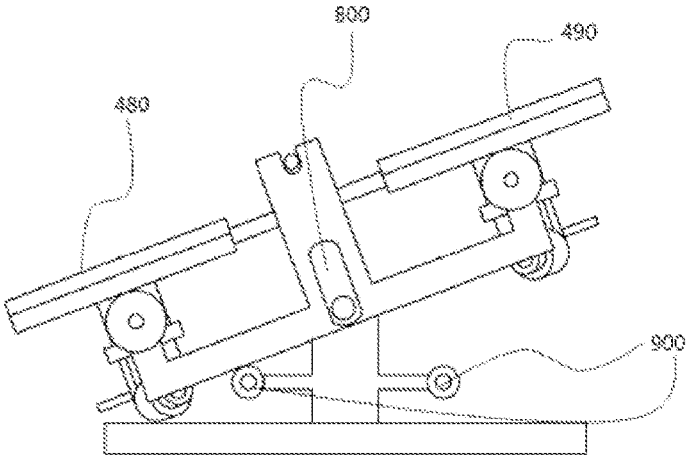
FIG. 15 is a rear view showing the foot plate parts which are stopped when the user gets on or off the foot plate parts applied to the multi-functional exercise apparatus of the present invention.

In addition, when the user gets on or off the foot plate parts, the stopping protrusions 900 preventing the left foot plate 480 and the right foot plate 490 from being brought into contact with the bottom may put the user in danger. Therefore, as shown in FIG. 15, a stopping recess 800 may further be provided to allow a seesaw center shaft of the left foot plate 480 and the right foot plate 490 to rise and descend so as to bring the lower portion into contact with the bottom when the user places a foot on only one of the left foot plate 480 and the right foot plate 490 to get on or off the foot plate parts. Accordingly, when a force is applied only to the one foot plate, the seesaw center shaft of the left foot plate 480 and the right foot plate 490 rise due to the presence of the stopping recess 800 and the lower portion of the left foot plate 480 or the right foot plate 490 is brought into contact with the bottom surface.

Figure 13:
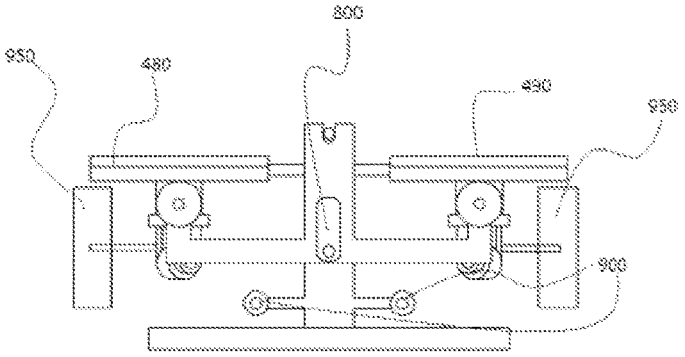
FIG. 13 is a rear view showing an example of rollers being applied to the foot plate parts applied to the multi-functional exercise apparatus of the present invention.
Figure 16:
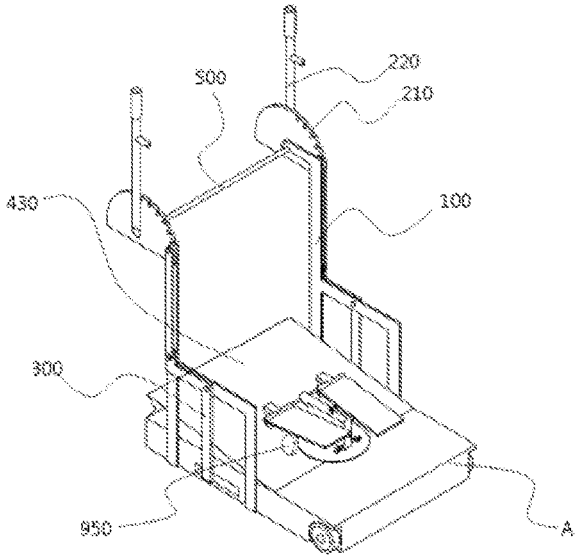
FIG. 16 is a perspective view showing the entirety of the multi-functional exercise apparatus of the present invention having a base plate elevated.

In addition, rollers 950 may further be provided under the left foot plate 480 and the right foot plate 490 as shown in FIG. 13. In the state in which the incline of the base plate 430 increases as shown in FIG. 16, this is to allow the user to do a step exercise in such a manner that the roller 950 of the left foot plate 430 naturally moves up along the inclined surface of the base plate 430 when the foot plate parts rotate to the right, and to allow the user to a step exercise in such a manner that the roller 950 of the right foot plate 490 naturally moves up along the inclined surface of the support plate 430 when the foot plate parts rotate to the left.

The foot plate parts 400 are connected to a rotary circular plate 410 disposed at the center of the body A, and are rotated to the right and the left as the rotary circular plate 410 rotates to the right and the left. In this case, the rotary circular plate 410 is connected with the rotatable frames 300 and inner operating frames 600 by means of the rope 700 or links and joints.

For example, as shown in FIG. 4, the inner operating frames 600 are formed in a bar shape, and have joints formed at one side and the other side thereof and are connected with the rope 700 or connected in the form of links and joints and rotated.

Due to the forward and backward rotation of the handle parts 200, the rotatable frames rotate forwards and backwards. Due to the rotation of the rotatable frames, the rotary circular plate connected with the rotatable frames via the rope 700 and the link and joints rotate to the right and the left, such that the foot plate parts can rotate to the right and the left.

Specifically, the user should alternately move the handle parts 200 provided at the both sides of the body A to perform a rowing exercise while alternately stretching and contracting both arms. In this case, the inner operating frames 600 which are connected with the rotatable frames 300 symmetrically formed are disposed to have the same inclination with reference to a certain point of the rope 700 and to alternate as shown in FIG. 3. Accordingly, when the user pushes one handle part 200 forwards and pulls the other handle part 200 backward, the foot plate parts 400 connected with the rotary circular plate 410 are rotated in one direction of the leftward direction and the rightward direction, and, when the user operates the handle parts 200 in reverse, the foot plate parts 400 are rotated in the other direction.

Next, the handle parts 200 are connected with the rotatable frames 300 and provided as to be rotatable forwards and backwards.

Figure 5:
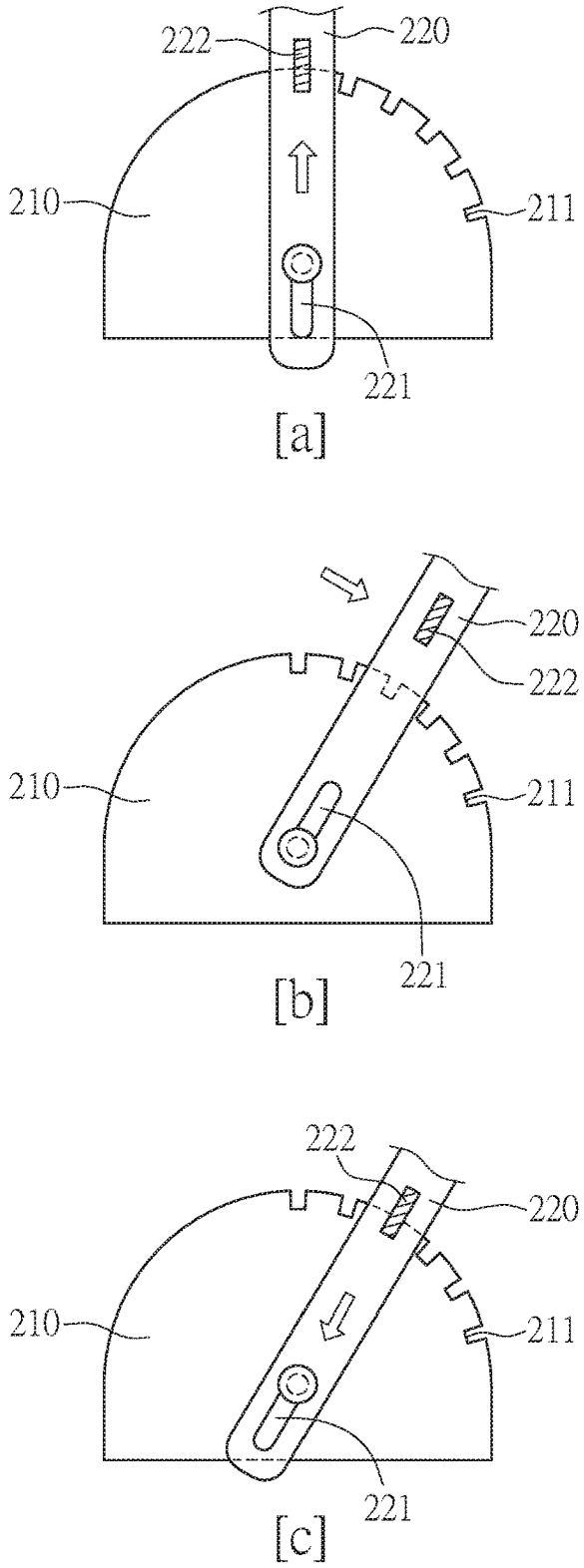
FIGS. 5*a* to 5*c* are views showing an example of a rotary plate and a main handle which are applied to the multi-functional exercise apparatus of the present invention, and are connected with and disconnected from each other.
Figure 6:
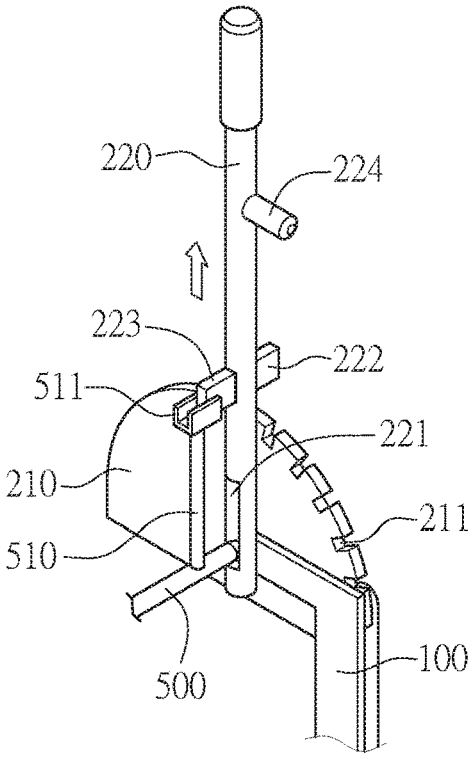
FIGS. 6*a* and 6*b* are views showing an example of the main handle and a seating mechanism which are applied to the multi-functional exercise apparatus of the present invention and are connected with and disconnected from each other.
Figure 6:
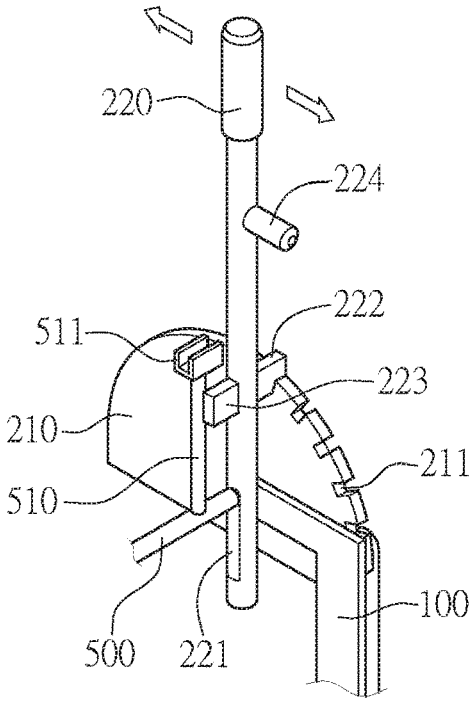

Specifically, as shown in FIGS. 5 and 6, the handle part 200 is provided with a rotary plate 210 which has a plurality of locking recesses 211 formed along the circumference thereof, has a center shaft-connected with the outer surface of the upper portion of the fixed frame 100 to rotate forwards and backwards, and has a side surface connected with the link of the rotatable frame 300, spaced from the center, so as to be interlocked with the link of the rotatable frame 300.

In addition, the handle part 200 may be provided with a main handle 220 having a predetermined length and connected with the outside of the rotary plate 210, and having a locking protrusion 222 formed on one side thereof to be inserted into the locking recess 211, and may further be provided with an auxiliary handle 224 attachably and detachably formed on one side of the center of the main handle 220.

In this case, by inserting the locking protrusion 222 into the locking recess 211, the angle of the main handle 220 may be adjusted.

Figure 7:
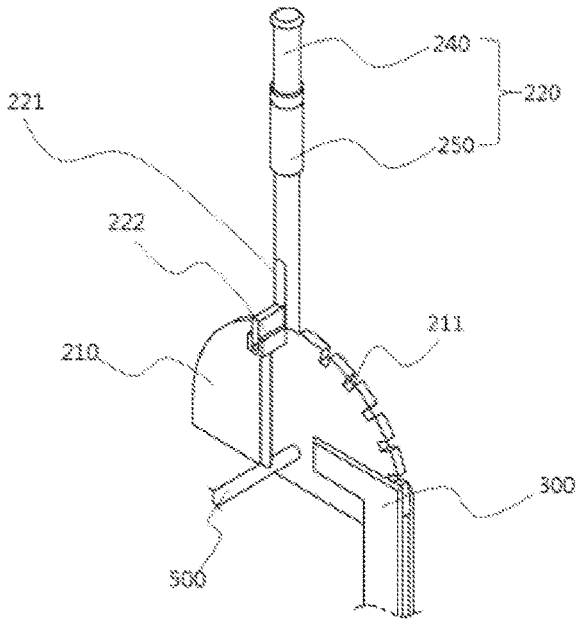
FIG. 7 is a perspective view showing another embodiment of the main handle applied to the multi-functional exercise apparatus of the present invention.

According to another embodiment, as shown in FIG. 7, the main handle 220 may include a handle piston 240 of a bar type having the locking protrusion 222 formed at a lower portion thereof, and a handle cylinder 250 formed in a bar shape and having a cavity formed therein to accommodate the lower portion of the handle piston 240, and having a protrusion recess 221 formed in a lengthwise direction so as to allow the locking protrusion 222 to protrude to the outside and move up and down.

Due to the configuration of the main handle 220 according to another embodiment, the angle of the handle part can be easily adjusted and a better sense of stability can be provided to the user when the handle part is rotated. More specifically, the position of the handle part is adjusted while lifting the handle piston 240, and then, by releasing the handle piston 240, the locking protrusion 222 is locked into the locking recess 211 of the rotary plate 210, such that the handle part 200 is positioned at a right position to be used by the user. To achieve this, a spring is provided inside the handle cylinder 250 to allow the handle piston 240 to have a downward elastic force. Therefore, when the user pulls the handle piston 240 to the outside and releases the handle piston 240 at a desired position, the handle piston 240 is inserted again due to the presence of the spring and the locking protrusion 222 is inserted into the locking recess 211.

By inserting the locking protrusion 222 into one of the plurality of locking recesses 211 described above, the user may select a range/angle of movements of user's both arms when doing a rowing exercise. For example, when the plurality of locking recesses 211 are formed on the rotary plate 210 as shown in FIG. 5*a*, the user may perform a rowing exercise forwards and backwards by inserting the locking protrusion 222 into the locking recess 211 formed at the uppermost end, and may perform a rowing exercise upwardly and downwardly by inserting the locking protrusion 222 into the locking recess 211 formed at the lowermost end. Accordingly, the user may perform exercises using different muscles by adjusting the position of the main handle 220.

Figure 17:
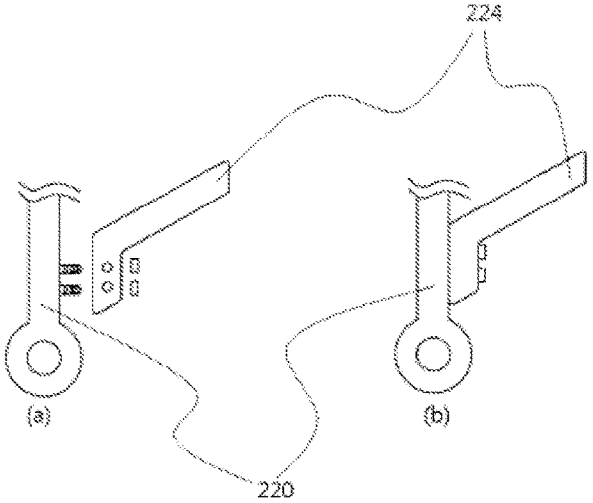
FIG. 17 is a view showing an example of an auxiliary handle being connected with the main handle applied to the multi-functional exercise apparatus of the present invention.

The auxiliary handle 224 may be configured to be attachable and detachable when necessary as shown in FIG. 17.

As shown in FIGS. 2 and 3, the multi-functional exercise apparatus may further include a horizontal frame 500 connecting the upper ends of the fixed frames 100 disposed on both side surfaces of the body A. The horizontal frame 500 serves as a handle when the user uses only the foot plate parts 400. In addition, as shown in FIG. 5*a*, the horizontal frame 500 may have a seating mechanism 510 protruding to be adjacent to the main handle 220, and the locking protrusion 222 inwardly formed on the main handle 220 may be inserted into the seating mechanism 510.

When the locking protrusion 222 is inserted into a seating recess 511, the main handle 220 is fixed and only the rotatable frames 300 and the rotary plate 210 interlocked with the foot plate parts 400 are driven according to the rightward and leftward rotation of the foot plate parts 400. Accordingly, the user can perform a twist exercise and a step exercise using only the foot plate parts 400.

As described above, the foot plate parts 400 are connected with the rotary circular plate 410 through the support plate 470 as shown in FIG. 11. The support plate 470 has a center portion protruding from the top surface thereof and thus a cross section formed in the shape of "⊥", and the two foot plate parts 400 are symmetrically connected with each other with reference to the support plate 470 through the protruding part, such that the user can perform the step exercise in addition to the twist exercise through the foot plate parts 400.

More specifically, a shaft pin 450 is formed on the front surface of the protruding part to be shaft-connected with the front surfaces of the two foot plate parts 400, and a support frame 440 is shaft-connected with the rear surface of the protruding part, such that the support frame 440 is rotated according to pressure applied to the foot plate parts 400 and thus the user can perform the step exercise.

Figure 18:
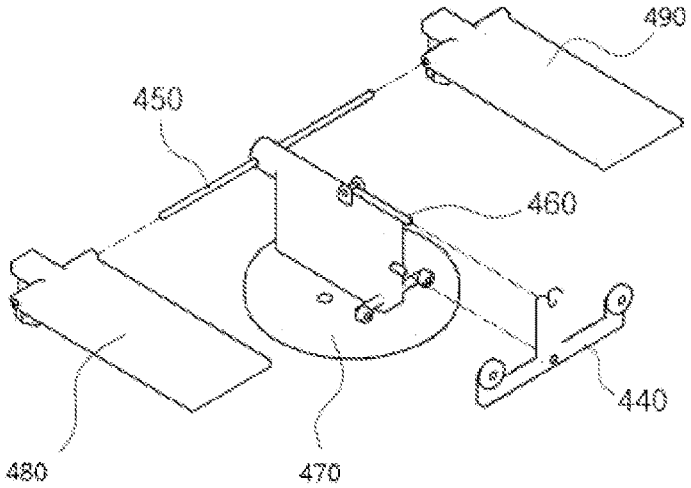
FIG. 18 is an exploded view showing a structure of foot plate parts applied to the multi-functional exercise apparatus of the present invention.

In addition, as shown in FIG. 18, a fixing pin 460 may be formed on the top surface of the protruding part so as to protrude backwardly during rotation, and the support frame 440 is formed in the shape of "⊥" and may have a recess formed on the center protruding therefrom to receive the fixing pin 460. When the fixing pin 460 is received in the recess formed on the support frame 440, the user is not allowed to perform the step exercise and is allowed to perform only the twist exercise using the foot plate parts 400.

In addition, as mentioned above, when the user performs the twist exercise on the foot plate parts 400 through the base plate 430 having a high incline toward the front surface, the user can naturally perform the step exercise in parallel with the twist exercise due to the inclined surface of the base plate 430.

It would be understood by a person skilled in the art that the present invention can be embodied in other specific forms without changing the technical idea or essential features of the present invention.

Therefore, the above-described embodiments should be understood as being exemplary and should not be considered as limiting from all aspects of the invention. The scope of the invention is defined not by the detailed description of the invention but by the appended claims, and all changes or changed forms derived from the meaning and range of the appended claims and equivalents thereof should be interpreted as being included in the scope of the present invention.

SEQUENCE LIST FREE TEXT

A: body
100: fixed frame
110: lower fixed frame
111: fixing protrusion
112: fixing mechanism
120: upper fixed frame
121: inserting mechanism
200: handle part
210: rotary plate
211: locking recess
220: main handle
222: locking protrusion
224: auxiliary handle
240: handle piston
250: handle cylinder
221: protrusion recess
300: rotatable frame
400: foot plate part
410: rotary circular plate
420: auxiliary circuit plate
430: base plate
440: support frame
450: shaft pin
460: fixing pin
470: support plate
480: left foot plate
490: right foot plate
500: horizontal frame
510: seating mechanism
511: seating recess
600: inner operating frame

700: rope
800: stopping recess
900: stopping protrusion
950; roller

What is claimed is:

1. A multi-functional exercise apparatus comprising:

a plate-shaped body which forms a bottom surface and has a space formed therein;

fixed frames which are fixedly disposed on both sides of the body in an upward direction;

rotatable frames which are disposed on both sides of the body in an upward direction and provided so as to be rotatable;

handle parts which are connected with upper portions of the rotatable frames and provided so as to be rotatable forwards and backwards; and foot plate parts which are provided on a top surface of the body and are connected with lower portions of the rotatable frames and provided so as to be rotatable, wherein the foot plate parts are rotated to the right and the left by forward and backward rotations of the handle parts, wherein each of the handle parts comprises:

a rotary plate which is connected to one side of each of the rotatable frames and is provided with a plurality of locking recesses formed along the outer circumference thereof;

a main handle which is formed in a bar shape and has a locking protrusion formed at one side of a lower portion thereof; and an auxiliary handle which is provided to be attachable to and detachable from one side of a center of the main handle, and wherein, by connecting the locking protrusion to the locking recess, an angle of the main handle is adjusted.

2. The multi-functional exercise apparatus of claim 1, wherein the rotatable frames comprise a plurality of links interlocked with one another.

3. The multi-functional exercise apparatus of claim 1, wherein the foot plate parts enable a step operation when being rotated.

4. The multi-functional exercise apparatus of claim 1, wherein the main handle comprises:

a handle piston which has the locking protrusion formed at a lower portion thereof and is formed in a bar shape; and a handle cylinder which is formed in a bar shape and has a cavity formed therein to receive a lower portion of the handle piston, and has a protrusion recess formed in a lengthwise direction so as to allow the locking protrusion to protrude to the outside and to move up and down, wherein a spring is provided inside the handle cylinder to apply a downward elastic force to the handle piston.

5. The multi-functional exercise apparatus of claim 1, wherein the fixed frames comprise:

lower fixed frames which are fixedly disposed on both side surfaces of the body;

upper fixed frames each of which has a lower end connected with an upper end of each of the lower fixed frames so as to be rotatable, and has an upper end connected with the handle part rotating forwards and backwards, wherein a fixing protrusion is formed at a position spaced from the upper end of the lower fixed frame on a front surface of the lower fixed frame, and an inserting mechanism having a predetermined length is formed at a lower end of the upper fixed frame on a front surface of the upper fixed frame to receive the fixing protrusion, wherein each of the fixed frames further comprises a fixing mechanism to be secured to the fixing protrusion and brought into contact with the inserting mechanism when being secured, and wherein, when the fixing mechanism is released from the fixing protrusion, the upper fixed frames are rotated backwards.

6. The multi-functional exercise apparatus of claim 1, wherein the foot plate parts comprise:

a support plate which forms a bottom surface;

a left foot plate which is provided on one side of an upper portion of the support plate and has a foot placed thereon; and a right foot plate which is provided on the other side of the upper portion of the support plate and has a foot paced thereon;

wherein the left foot plate and the right foot plate are configured to be rotatable with the fore parts thereof having a fixed height, and the back parts thereof connected with each other in a seesaw form, such that a step exercise is naturally performed when the foot plate parts are rotated.

7. The multi-functional exercise apparatus of claim 6, wherein the foot plate parts comprise:

stopping protrusions which protrude under the back parts of the left foot plate and the right foot plate, and are provided to prevent the lower portions of the left foot plate and the right foot plate from being brought into contact with a bottom when the user performs a step exercise on the foot plate parts; and a stopping recess which is configured to allow a seesaw center shaft of the left foot plate and the right foot plate to rise and descend so as to bring the lower portions of the left foot plate and the right foot plate into contact with the bottom for the sake of safety when the user gets on or off the foot plate parts.

8. The multi-functional exercise apparatus of claim 6, further comprising rollers formed under the left foot plate and the right foot plate, and wherein, in a state in which the incline of the base plate increases, a step exercise is performed in such a manner that the roller of the left foot plate naturally moves up along an inclined surface of the base plate when the foot plate parts are rotated to the right, and a step exercise is performed in such a manner that the roller of the right foot plate naturally moves up along the inclined surface of the base plate when the foot plate parts are rotated to the left.

9. The multi-functional exercise apparatus of claim 1, further comprising a base plate which is formed on a top surface of the body and is able to adjust an incline to be elevated toward a user.

10. The multi-functional exercise apparatus of claim 1, wherein the rotatable frames and the foot plate parts are interlocked with each other via links and a rope and are rotatable.

* * * * *